US010068563B2

(12) United States Patent
D'Antonio et al.

(10) Patent No.: US 10,068,563 B2
(45) Date of Patent: Sep. 4, 2018

(54) SOUND ABSORBING PANEL WITH WEDGE-SHAPED CROSS-SECTION MICRO-SLITS

(71) Applicants: Peter D'Antonio, Upper Marlboro, MD (US); Jeff Madison, Wallingford, PA (US)

(72) Inventors: Peter D'Antonio, Upper Marlboro, MD (US); Jeff Madison, Wallingford, PA (US)

(73) Assignee: RPG ACOUSTICAL SYSTEMS LLC

( * ) Notice: Subject to any disclaimer, the term of this patent is extended or adjusted under 35 U.S.C. 154(b) by 0 days.

(21) Appl. No.: 14/944,423

(22) Filed: Nov. 18, 2015

(65) Prior Publication Data

US 2018/0090122 A1 Mar. 29, 2018

(51) Int. Cl.

| | |
|---|---|
| ***G10K 11/162*** | (2006.01) |
| ***E04B 1/82*** | (2006.01) |
| ***E04B 1/86*** | (2006.01) |
| *E04B 1/84* | (2006.01) |

(52) U.S. Cl.
CPC ..... *G10K 11/162* (2013.01); *E04B 1/86* (2013.01); *E04B 2001/849* (2013.01); *E04B 2001/8495* (2013.01)

(58) Field of Classification Search
CPC .... G10K 11/162; E04B 1/8209; E04B 1/8409
USPC ..... 181/286.293
See application file for complete search history.

(56) References Cited

U.S. PATENT DOCUMENTS

| | | | | |
|---|---|---|---|---|
| 2,165,101 | A * | 7/1939 | Hudson | E04B 1/8409 181/293 |
| 5,700,527 | A | 12/1997 | Fuchs | |
| 6,194,052 | B1 | 2/2001 | Knipsteln | |
| 6,815,044 | B2 * | 11/2004 | Boock | B32B 3/30 181/293 |
| 7,677,359 | B2 | 3/2010 | Vigran et al. | |
| 2001/0050197 | A1 | 12/2001 | Wood | |
| 2005/0133302 | A1 * | 6/2005 | Pfaffelhuber | B60R 13/08 181/293 |
| 2012/0155688 | A1 * | 6/2012 | Wilson | H04R 7/26 381/354 |
| 2013/0087408 | A1 * | 4/2013 | Mader | E04B 1/84 181/292 |

FOREIGN PATENT DOCUMENTS

| | | | | |
|---|---|---|---|---|
| EP | 2540926 | A1 * | 1/2013 | E04B 1/86 |

OTHER PUBLICATIONS

Translation of EP2540926A1; <http://translationportal.epo.org/emtp/translate/?ACTION=description-retrieval&CUNTRY=EP&ENGINE=google&FORMAT=docdb&KIND=A1&LOCALE=en_EP&NUMBER=2540926&OPS=ops.epo.org/3.1&SRCLANG=de&TRGLANG=en>; accessed Oct. 4, 2016.*

* cited by examiner

*Primary Examiner* — Jeremy Luks
(74) *Attorney, Agent, or Firm* — H. Jay Spiegel

(57) ABSTRACT

An acoustical panel has a multiplicity of short micro-slits, about 10 mm in length each, with each micro-slit having a wedge shaped cross-section in which the opening on the front side of the panel is wider than the opening on the rear side of the panel by a factor of about 2 to effectively absorb sound frequencies in the range of 250-2000 Hz, with the micro-slits greater than 4%. The micro-slits are spaced apart less than 5 mm and several different patterns of micro-slits may be employed including micro-slits that are straight as well as arcuate or some combination of straight and arcuate. The area of the micro-slits on the front surface of the panel exceeds 4%.

19 Claims, 3 Drawing Sheets

FIG 3 RAIN
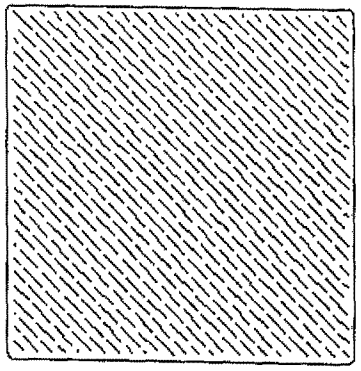
4.2222 %
FIG 4 WAVE
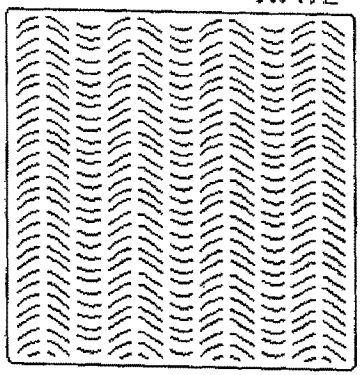
4.0076 %
FIG 5 FLOW
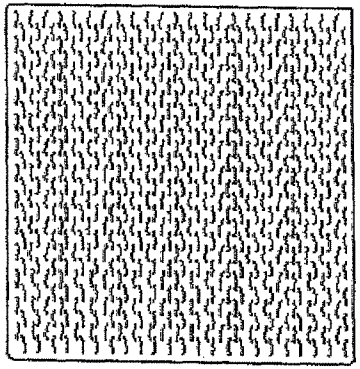
4.09 %
FIG 6 THISTLE
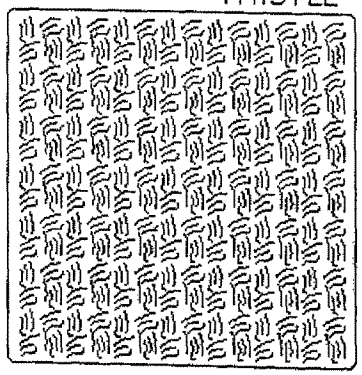
5.054 %
FIG 7 CLOVER
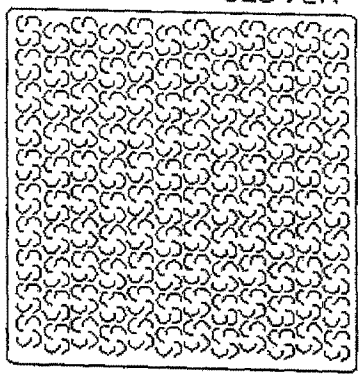
4.377 %
FIG 8 PARQUET
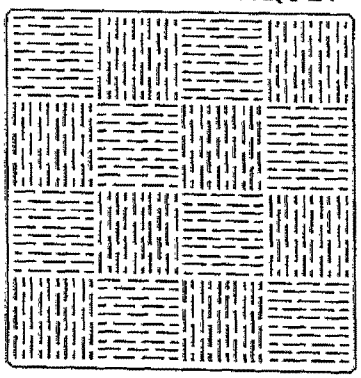
4.3144 %

SOUND ABSORBING PANEL WITH WEDGE-SHAPED CROSS-SECTION MICRO-SLITS

BACKGROUND OF THE INVENTION

The present invention relates to a sound absorbing panel with wedge-shaped cross-section micro-slits. Acousticians have long sought a sound absorbing panel to control reverberation in a room. In some applications, it is preferable for the panel to be fully transparent so that illumination means can be located behind the panel to combine illumination with acoustical treatment. Glazing is a popular building material and has considerable advantages in combining lighting and acoustical function into one panel to save on materials and costs.

The concept of micro-perforation of a panel was first pioneered by D-Y Maa in the 1970s. Maa proposed providing a panel with a multiplicity of small holes to attenuate noise in rooms. The holes contemplated by Maa have diameters less than 1 mm, perhaps as small as 0.1 mm.

Absorbers of this type are Helmholtz resonator type devices but devoid of the usual resistive material. Such devices provide absorption through his viscous losses as air passes through small holes which are only slightly larger than the boundary layer of air. Inherent damping eliminates the need for fiberglass or other porous materials in the air cavity behind the panel.

For high absorption of sound, Maa showed that the panel thickness and hole diameter should be the same. Hence, high frequency absorbing devices are typically foils of polycarbonate or ETFE. The requirement of Maa for small holes restricts the frequency range over which the resonant absorption can be achieved within manufacturing constraints. Thicker materials are useful devices for treating troublesome low to mid frequency noise and reverberance.

U.S. Pat. No. 5,700,527 to Fuchs et al. discloses a sound absorbing glass building component that is provided with micro-perforated holes having a diameter of from 0.1-2.0 mm with the holes being spaced 2-20 mm apart and the panel having a thickness of 0.2-30 mm.

U.S. Pat. No. 6,194,052 to Knipstein discloses a sound absorbing element that includes a plurality of micro-slits that have non-uniform widths along their lengths including extremely narrowed ends. The Knipstein panel enhances sound absorption at extremely low frequencies, typically less than 300 Hz.

Published Application No. U.S. 2001/0050197 to Wood discloses a micro-perforated panel in which the micro-perforations may comprise tapered holes.

U.S. Pat. No. 7,677,359 to Vigran et al. discloses a sound absorbent panel in which a multiplicity of micro-slits is formed therein. The micro-slits are linear and have facing walls lying in parallel planes. The micro-slits in Vigran et al. have a minimum micro-slit width of less than 0.45 mm. The ratio between the length of each micro-slit and its width is at least 50. Moreover, the perforation level of panels made in accordance with the teachings of Vigran et al. is less than 3%.

SUMMARY OF THE INVENTION

The present invention relates to a sound absorbing panel with wedge-shaped cross-section micro-slits. The present invention includes the following interrelated objects, aspects and features:

(1) In the present invention, Applicants have found that by providing a multiplicity of short micro-slits, about 10 mm in length each, with each micro-slit having a wedge shaped cross-section in which the opening on the rear side of the panel is wider than the opening on the front side of the panel by a factor of about 2 enables one to effectively absorb sound frequencies in the range of 250-2000 Hz, particularly where the area of the panel subtended by the micro-slits is greater than 4%. By contrast, in the Vigran et al. patent, the area subtended by the micro-slits is less than 3%.

(2) In the present invention, micro-slits are spaced apart less than 5 mm and several different patterns of micro-slits may be employed including micro-slits that are straight as well as arcuate or some combination of straight and arcuate. The only requirements for the micro-slits is that their length is limited to about 10 mm, their consistent cross-section is wedge-shaped with the width of the opening on the front side smaller than the width of the opening on the rear side by a factor of about 2 and that the area of the micro-slits on the front surface of the panel exceeds 4% of the total panel area.

(3) When these criteria are achieved, the sound frequency with the greatest absorption coefficient as compared to that of the panels of the Vigran et al. invention is raised by approximately an octave. In this regard, the Vigran et al. panels demonstrate peak absorption at in the range of 300-400 Hz whereas in the present invention, peak absorption occurs at frequencies in the range of 650-900 Hz, approximately an octave higher. In this way, the present invention more efficiently absorbs higher frequency sounds.

As such, it is a first object of the present invention to provide a sound absorbing panel with wedge-shaped cross-section micro-slits.

It is a further object of the present invention to provide such a panel which may, if desired, be transparent to facilitate combining acoustic and lighting aspects in a room or space.

It is a further object of the present invention to provide such a panel in which the surface is perforated with a multiplicity of micro-slits having wedge-shaped cross-sections.

It is a yet further object of the present invention to provide such a panel in which the front surface thereof has micro-slits that encompass at least 4% of the front surface area of the panel.

It is a yet further object of the present invention to provide such a panel in which micro-slits have a width on the front surface of the panel of about 0.25 mm and at the rear surface of the panel approximately 0.5 mm in width.

It is a yet further object of the present invention to provide such a panel in which the micro-slits formed therethrough are straight, curved, or some combination of straight and curved.

It is a yet further object of the present invention to provide such a panel in which the sound absorbing performance thereof is shifted to a greater octave than is the case with respect to prior art micro-slitted panels.

These and other objects, aspects and features of the present invention will be better understood from the following detailed description of the preferred embodiments when read in conjunction with the appended drawing figures.

BRIEF DESCRIPTION OF THE DRAWINGS

FIGS. 3-8 show front views of panels bearing a variety of micro-slits of differing shapes and configurations.

SPECIFIC DESCRIPTION OF THE PREFERRED EMBODIMENTS

Figures 1, 2:
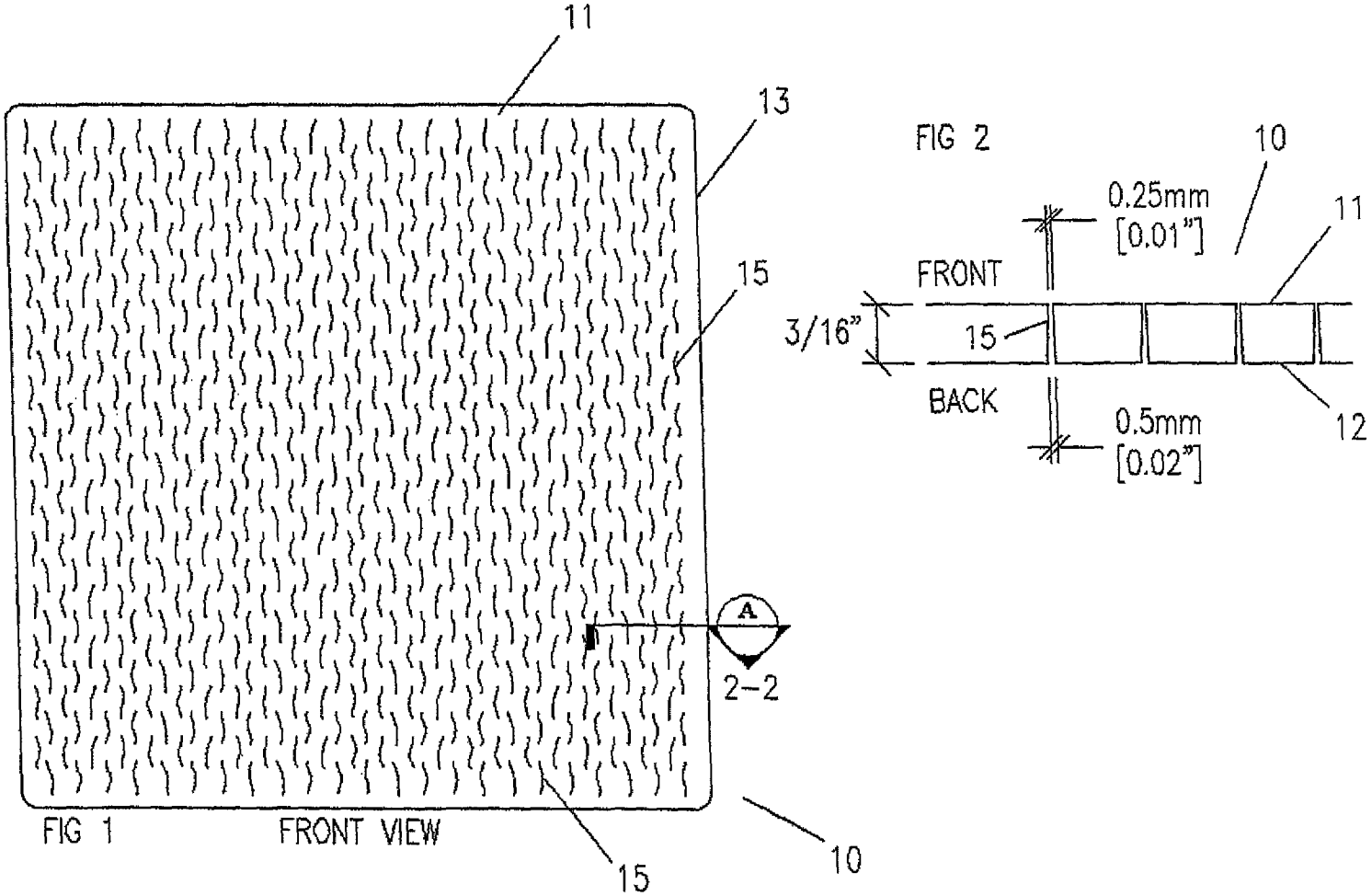
FIG. 1 shows a view of an example of a front surface of a panel made in accordance with the teachings of the present invention.
FIG. 2 shows a cross-sectional view along the line 2-2 of FIG. 1.

Reference is first made to FIG. 1 which shows a rectangular panel 10 having a front surface 11 and a peripheral edge 13. The surface 11 of the panel 10 exhibits a multiplicity of micro-slits 15. The pattern of micro-slits in FIG. 1 is generally the same as that which is depicted in FIG. 5 described by the name "FLOW." As is clear in FIG. 1, the micro-slits are generally arcuate shaped in that embodiment of the present invention.

With reference to FIG. 2, the panel 10 has the front surface 11 as well as a back or rear surface 12. FIG. 2 is a cross-section through several ones of the micro-slits 15. As seen, the cross-section of the micro-slits is wedge-shaped with the width being smaller at the front surface 11 of the panel 10 than the width at the back surface 12 of the panel 10. This cross-section is maintained substantially consistent throughout the length of each micro-slit.

In the example shown in FIG. 2, the width of the micro-slits at the front surface 11 of the panel 10 is about 0.25 mm or 0.01". At the back surface 12 of the panel 10, the width of the micro-slits is about 0.5 mm or 0.02". Thus, the ratio between the width of the micro-slits at the front surface of the panel and the width at the back or rear surface of the panel is approximately 1:2 or double the width at the back or rear surface of the panel as compared to at the front surface of the panel. Of course, the width at the front of the panel has a tolerance of ±0.05 mm and at the back or rear of the panel of ±0.1 mm. The ratio between the width at the front and back or rear is preferably 0.5±0.1.

Moreover, in the preferred embodiment of the present invention, the spacing between adjacent micro-slits is preferably less than 5 mm. Additionally, the preferred micro-slit length is about 10 mm so that the ratio between the length of the micro-slit and its width at the front surface of the panel is preferably less than 50, preferably about 40.

Moreover, in the preferred embodiments of the present invention, the open area on the front surface 11 of the panel 10 formed by micro-slits is preferably greater than 4%. Through experimentation, Applicants have found, unexpectedly, that when the above-described dimensions of the micro-slits, including their wedge-shaped cross-section, their spacing apart, and the total open area subtended by all of the micro-slits combined is greater than 4%, the panel 10 effectively absorbs sound within the range of 250-2000 Hz with a focus on the sound octave encompassing around 1000 Hz.

Figure 9:
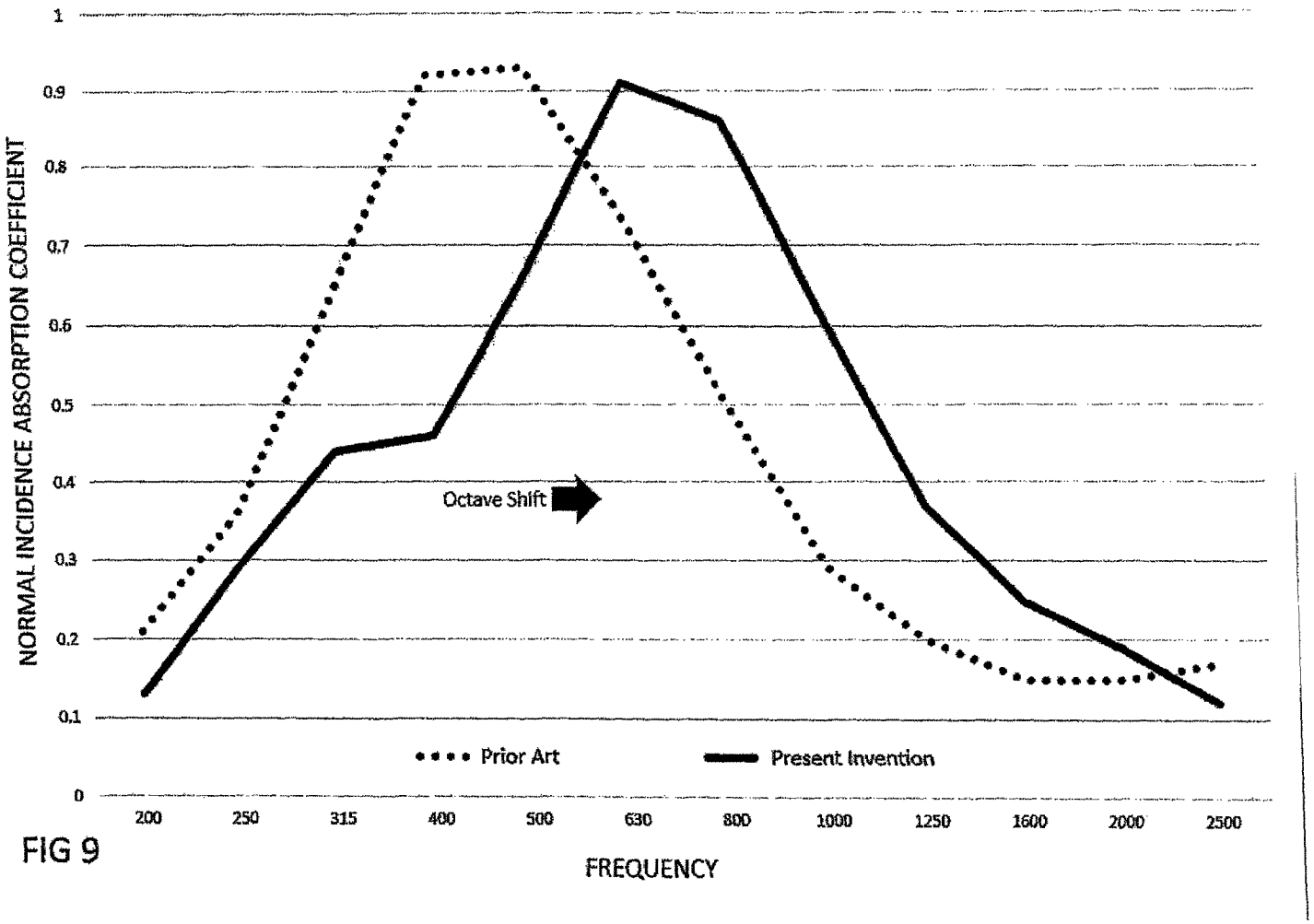
FIG. 9 shows a graph comparing the sound absorbing performance of the present invention as compared to the invention disclosed in U.S. Pat. No. 7,677,359 to Vigran et al.

With reference to FIG. 9, a graph is provided that compares the normal incidence absorption coefficient versus frequency for the present invention as compared to the invention disclosed in U.S. Pat. No. 7,677,359. As clearly seen in the graph, the peak absorption coefficient for the present invention is approximately one octave higher than that of the device disclosed in U.S. Pat. No. 7,677,359. As shown, the peak absorption coefficient for the prior art device falls within the range of 300-450 Hz, whereas in the present invention, the peak falls within the range of 600-900 Hz.

With reference to FIGS. 3-8, it is seen that the micro-slits of the present invention may be formed in a variety of patterns, even over and above those shown in FIGS. 3-8, so long as the criteria are maintained that the area subtended by the openings on the front surface of the panel exceeds 4% of the total area and details of the wedge-shaped cross-section, width to length ratio, and slit spacing are as disclosed herein. Thus, FIG. 3 shows a pattern described as "RAIN." FIG. 4 shows a pattern described as "WAVE." FIG. 5 shows a pattern described as "FLOW" and corresponds to the view of FIG. 1. FIG. 6 shows a pattern described as "THISTLE." FIG. 7 shows a pattern described as "COVER." FIG. 8 shows a pattern described as "PARQUET" and resembles a parquet floor with orthogonally disposed micro-slits. Each figure displays a number percent under the figure. Those numbers correspond to the percentage of open area subtended by the micro-slits in each respective figure. As is seen, in each case, the figure is greater than 4%.

If desired, the inventive panels may be installed, for example, in a ceiling of a room or space with a cavity located behind each panel. However, in light of the teachings of the present invention, it is not required to provide any sound absorbing material adjacent the back surface 12 of each panel. The panel 10 may be transparent for clear vision through it or translucent for lighting effects, as desired. In the preferred embodiments, the panel thickness can range from about ⅛" (about 3 mm) to about ½" (about 12-13 mm).

Comparing the present invention with the invention disclosed in U.S. Pat. No. 7,677,359 to Vigran et al., Vigran et al. have a target frequency of sound absorption in the range of 100-200 Hz, a low frequency indeed. By contrast, where micro-slits are provided in panels in accordance with the teachings of the present invention, the target frequency is in the range of 250-2000 Hz to provide enhanced general noise control over a wider frequency range focusing on the octave around 1000 Hz. While the present invention is not intended to provide enhanced sound absorption at a low frequency range such as the 100-200 Hz range of the Vigran et al. invention, the much wider range of sound absorption exhibited by the present invention is believed a dramatic improvement over Vigran et al. and the other prior art known to Applicants.

As such, an invention has been disclosed in terms of preferred embodiments thereof which fulfill each and every one of the objects of the invention as set forth hereinabove, and provide a new and useful sound absorbing panel with wedge-shaped cross-section micro-slits of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A sound absorbing panel comprising:

a) a panel having a front surface and a back surface;

b) a multiplicity of micro-slits formed in said panel and extending from said front surface to said back surface, each micro-slit having an entrance at said front surface and an exit at said back surface;

c) each of said micro-slits having a direction of elongation and a wedge-shaped cross-section perpendicular to said direction of elongation, each micro-slit having a substantially uniform first width at said front surface entrance and a substantially uniform second width at said back surface exit, said second width at said back surface being greater than said first width at said front surface; and d) a surface area subtended by all of said micro-slits at said front surface combined being at least 4% of a surface area of said front surface;

e) whereby sound enters said micro-slits at each entrance and exits said micro-slits at each exit, said sound being absorbed at a frequency range of 250-2000 Hz.

2. The panel of claim 1, wherein said panel is transparent.

3. The panel of claim 1, wherein said panel is rectangular.

4. The panel of claim 1, wherein said first width is about 0.25 mm±0.05 mm.

5. The panel of claim 4, wherein said second width is about 0.5 mm±0.1 mm.

6. The panel of claim 5, wherein a ratio between said second width and said first width is about 2:1±10%.

7. The panel of claim 1, wherein said panel exhibits optimal sound absorption at a frequency range of about 600-900 Hz.

8. The panel of claim 1, wherein each micro-slit has a length of about 10 mm.

9. The panel of claim 8, wherein a ratio between length and width at front surface for each micro-slit is about 40.

10. The panel of claim 1, wherein said micro-slits form a "RAIN" pattern.

11. The panel of claim 1, wherein said micro-slits form a "WAVE" pattern.

12. The panel of claim 1, wherein said micro-slits form a "FLOW" pattern.

13. The panel of claim 1, wherein said micro-slits form a "THISTLE" pattern.

14. The panel of claim 1, wherein said micro-slits form a "CLOVER" pattern.

15. The panel of claim 1, wherein said micro-slits form a "PARQUET" pattern.

16. A sound absorbing panel comprising:

a) a transparent panel having a front surface and a back surface;

b) a multiplicity of micro-slits formed in said panel and extending from said front surface to said back surface, each micro-slit having an entrance at said front surface and an exit at said back surface;

c) each of said micro-slits having a direction of elongation and a wedge-shaped cross-section perpendicular to said direction of elongation, each micro-slit having a substantially uniform first width of about 0.25 mm±0.05 mm at said front surface entrance and a substantially uniform second width of about 0.5 mm±0.1 mm at said back surface exit, said second width at said back surface being greater than said first width at said front surface at a ratio of about 2:1±10%; and d) a surface area subtended by all of said micro-slits at said front surface combined being at least 4% of a surface area of said front surface;

e)whereby sound enters said micro-slits at each entrance and exits said micro-slits at each exit, said sound being absorbed at a frequency range of 250-2000 Hz.

17. The panel of claim 16, wherein said panel is rectangular.

18. The panel of claim 16, wherein said panel exhibits optimal sound absorption at a frequency range of about 600-900 Hz.

19. The panel of claim 16, wherein each micro-slit has a length of about 10 mm and a ratio between length and width at front surface for each micro-slit is about 40.

* * * * *